US008903730B2

(12) United States Patent
Zong et al.

(10) Patent No.: US 8,903,730 B2
(45) Date of Patent: Dec. 2, 2014

(54) CONTENT FEATURE-PRESERVING AND COMPLEXITY-SCALABLE SYSTEM AND METHOD TO MODIFY TIME SCALING OF DIGITAL AUDIO SIGNALS

(75) Inventors: Wenbo Zong, Singapore (SG); Yuan Wu, Singapore (SG); Sapna George, Singapore (SG)

(73) Assignee: STMicroelectronics Asia Pacific Pte Ltd, Singapore (SG)

( * ) Notice: Subject to any disclaimer, the term of this patent is extended or adjusted under 35 U.S.C. 154(b) by 653 days.

(21) Appl. No.: 12/897,635

(22) Filed: Oct. 4, 2010

(65) Prior Publication Data

US 2011/0099021 A1 Apr. 28, 2011

Related U.S. Application Data

(60) Provisional application No. 61/278,056, filed on Oct. 2, 2009.

(51) Int. Cl.
*G10L 21/04* (2013.01)

(52) U.S. Cl.
CPC ..... *G10L 21/04* (2013.01)
USPC ..... 704/503

(58) Field of Classification Search
CPC ..... G10L 21/04; G10L 21/0208
See application file for complete search history.

(56) References Cited

U.S. PATENT DOCUMENTS

2003/0074197 A1* 4/2003 Chen ..... 704/262
2009/0192803 A1* 7/2009 Nagaraja et al. ..... 704/278
2010/0042407 A1* 2/2010 Crockett ..... 704/200.1

* cited by examiner

*Primary Examiner* — Jakieda Jackson
(74) *Attorney, Agent, or Firm* — Allen, Dyer, Doppelt, Milbrath & Gilchrist, P.A.

(57) ABSTRACT

A time-domain system and method of modifying the time scale of digital audio signals includes a pre-processor. The pre-processor forms a synthesized signal for processing with minimum computation and that has optional features to give preference to certain audio channels and/or frequency bands, a mechanism of adaptively characterizing the temporal features of the synthesized signal by its normalized power and zero-crossing count, and a mechanism of identifying a segment of the synthesized signal where the time scale can be modified without introducing artifacts or losing content.

22 Claims, 7 Drawing Sheets

CONTENT FEATURE-PRESERVING AND COMPLEXITY-SCALABLE SYSTEM AND METHOD TO MODIFY TIME SCALING OF DIGITAL AUDIO SIGNALS

CROSS-REFERENCE TO RELATED APPLICATIONS AND CLAIM OF PRIORITY

The present application is related to U.S. Provisional patent Application No. 61/278,056, filed Oct. 2, 2009, entitled "CONTENT FEATURE-PRESERVING AND COMPLEXITY-SCALABLE SYSTEM AND METHOD TO MODIFY TIME SCALING OF DIGITAL AUDIO SIGNALS". Provisional Patent Application No. 61/278,056 is assigned to the assignee of the present application and is hereby incorporated by reference into the present application as it fully set forth herein. The present application hereby claims priority under 35 U.S.C. §119(e) to U.S. Provisional Patent Application No. 61/278,056.

TECHNICAL FIELD

The present disclosure relates generally to audio signal processing and, in particular, to systems and methods to modify the time scale of digital audio signals.

BACKGROUND

Conventional methods for time scaling digital audio signals broadly fall into two general categories: time-domain methods, and frequency-domain methods. A sound waveform generally exhibits repetition of a certain shape locally, especially for speech signals. Each of these repeated waveforms includes an almost identical spectrum and, thus, sounds very similar. Accordingly, such repetitions may be added or dropped without changing the sound. This is generally the theoretical basis for time-domain time scaling processes. For example, such processes could identify two splicing points, between which the samples are dropped for compressing the time scale or are repeated for stretching the time scale. The optimal splicing points have to be found jointly, because changing one point may lead to a different optimal location for the other point. The difficulty lies in the fact that there are often too many possible combinations of two splicing points. Accordingly, exhaustive searches are not feasible for real-time processing due to the prohibitively high computational costs associated with such processing.

The frequency-domain method can work by interpolating/extrapolating the frequency samples. Since the signal often is PCM samples in the time domain, conventional frequency-domain methods involve windowing the time-domain signal by a smooth window such as, for example, a raised cosine window. Then, these methods can include transforming the windowed time-domain signal into a frequency-domain representation by a transformation method like discrete Fourier transform (DFT), or fast Fourier transform (FFT) for fast computation. The desired frequency samples (according to the corresponding desired time scaling factors) are then obtained from the obtained frequency samples, through interpolation/extrapolation, where both magnitude and phase are handled.

SUMMARY

Embodiments of the present disclosure generally provide a systems and methods for modifying the time scale of digital audio signals. The system and method can include synthesizing a single-channel signal from the input digital audio signal with preferences given to certain audio channels and/or certain frequency bands. In addition, the system and method can include analyzing the temporal characteristics of the synthesized signal and identifying portions of the synthesized signal with high likelihood of existence of regular periodic waveform. The system and method can further include finding the optimal splicing points to drop or repeat samples within the identified segment through a two-step search approach for reduced complexity while maintaining good quality.

Other technical features may be readily apparent to one skilled in the art from the following figures, descriptions and claims.

Before undertaking the DETAILED DESCRIPTION OF THE INVENTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

FIGS. 1 through 14, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system.

It can be difficult to maintain the timbre of the sound, which is very sensitive to the phase, when using frequency-domain methods. Another major difficulty is to maintain the fast-changing temporal features of the signal, because simple interpolation/extrapolation of frequency samples may smear the temporal features, which is particularly undesirable for temporal transients.

Figure 1:
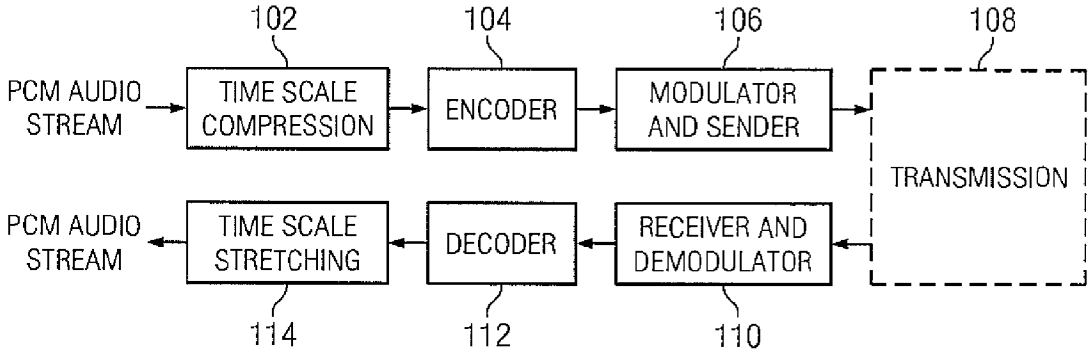
FIG. 1 illustrates a block diagram for a time scale modification system according to embodiments of the present disclosure.

FIG. 1 illustrates a block diagram for a time scale modification system according to embodiments of the present disclosure. The embodiment of the system shown in FIG. 1 is for illustration only. Other embodiments could be used without departing from the scope of this disclosure. In the embodiment shown in FIG. 1, a PCM audio stream is shown as an input into a time scale compression module 102 which outputs into an encoder 104, and then the encoder 104 outputs the encoded signal to modulator and sender module 106. The modulator and sender 106 then outputs to transmission module 108. Transmission module 108 sends the input signal to a receiver and demodulator module 110, and the receiver and demodulator module which passes a demodulated signal into a decoder 112, and the decoder 112 passes a decoded signal into a time scale and stretching module 114 which outputs a PCM audio stream.

Embodiments of the present disclosure generally solve the problem of modifying the time scale of a digital audio signal without changing its timbre and pitch. The time scale can be made larger, in which case the sound tempo is perceived as being slower than original. Additionally, the time scale can be made shorter, in which case the sound tempo is perceived as being faster than original. A broad range of applications often can require such a change in time scale for the fast and slow playback modes, such as, for example, language learning tools, media playback software, home entertainment devices, Digital Virtual Disc (DVD) player, and the like. Additionally, such changes in time scale also can be used in transmission applications where the bandwidth is limited, such as, for example, for which the original signal may first be compressed in time scale before encoding at the sender and stretched back to the original time scale after decoding at the receiver.

Figure 2:
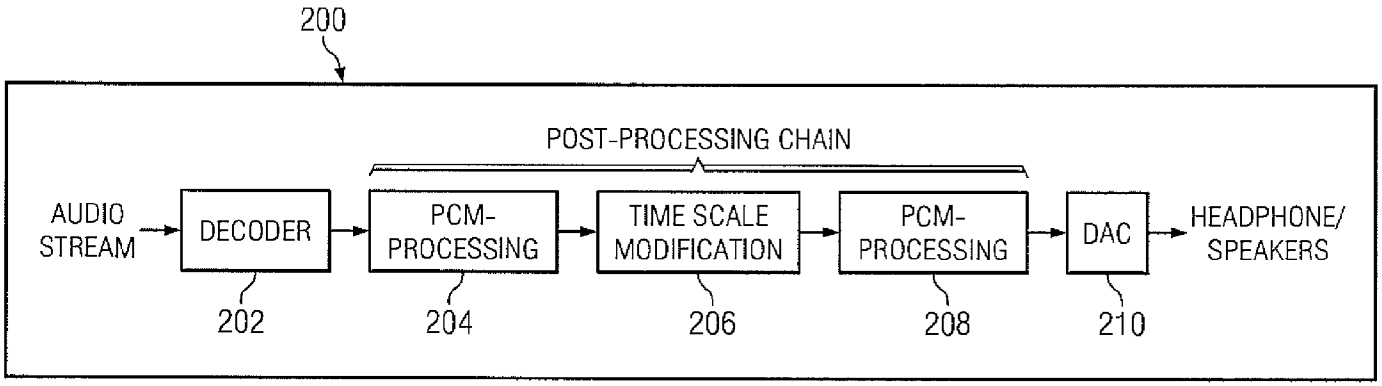
FIG. 2 illustrates a block diagram for a processing path for time scale modification in media playback according to embodiments of the present disclosure.

FIG. 2 illustrates a block diagram for a processing path for time scale modification in media playback according to embodiments of the present disclosure. The embodiment of the processing path shown in FIG. 2 is for illustration only. Other embodiments could be used without departing from the scope of this disclosure. In the embodiment shown in FIG. 2, an audio stream is input into decoder 202 which outputs a decoded signal into PCM-processing module 204. The PCM-processing module outputs 204 outputs a modulated signal into time and scale modification module 206. The PCM-processing module 208 processes the signal and outputs the signal into a digital to analog converter (DAC) 210 which converts the signal into analog and outputs the signal. In the example shown in FIG. 2, the output is illustrating going to a headphone or speaker device, however it is explicitly understood that any output could be used. An e The application of time scaling a digital audio signal is can be included as one module in a post-processing chain, as illustrated in FIG. 2. Distributed and/or stored audio contents can be encoded for reduction in data size and content protection. Therefore, the audio stream first can be decoded before entering the post-processing chain. The time scale modification module processes the PCM samples received from the previous module or received directly from the decoder. The time scale modification module outputs PCM samples to the next module in the chain. At the end of post-processing chain, a digital-to-analog converter (DAC) converts the PCM samples into an analog signal for playback on speakers/headphone. The time scale modification method in other application scenarios can include a same or substantially similar system interface.

In one embodiment, the present disclosure provides a method of time scaling digital audio signals that processes the signal in the time-domain. The method can modify the time scale by dropping and/or repeating segments of the signal at the 'appropriate' time. The appropriateness of whether and when to drop and/or repeat samples is determined by heuristics derived from the signal's temporal features and waveform similarity.

Figure 3:
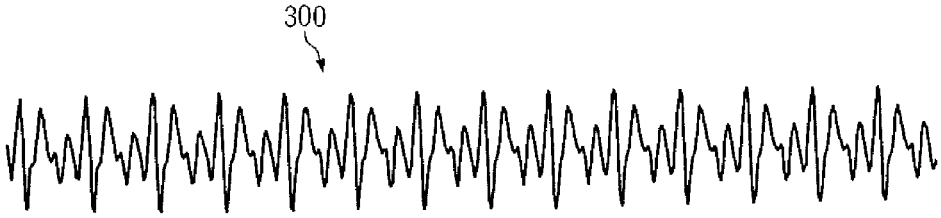
FIG. 3 illustrates a segment of an audio waveform that exhibits periodicity according to embodiments of the present disclosure.
Figure 4:
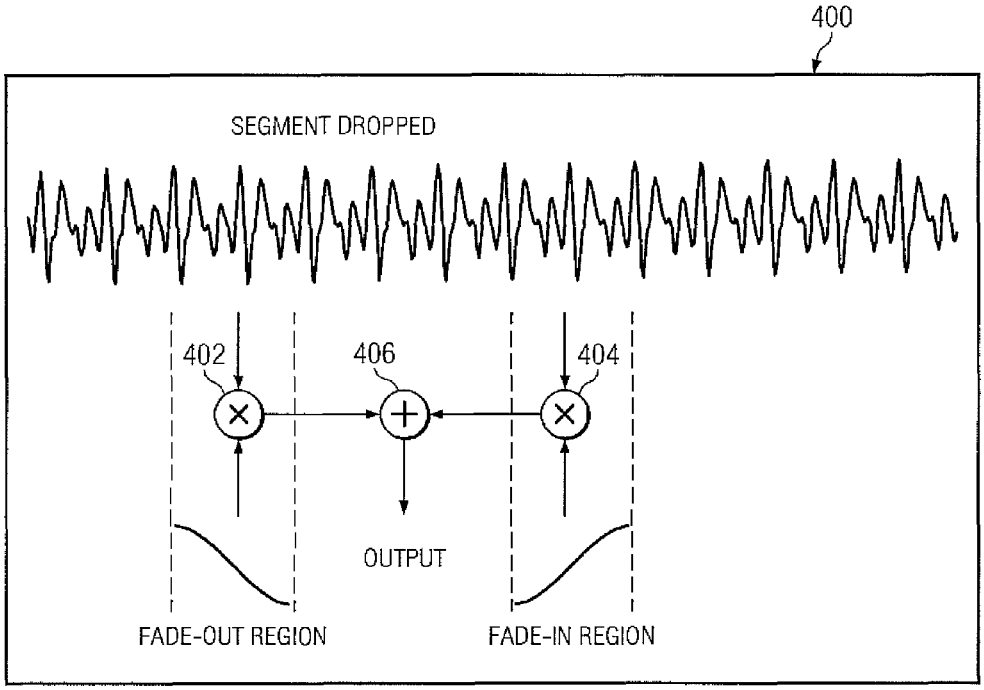
FIG. 4 illustrates an example of a time scale compression according to embodiments of the present disclosure.
Figure 5:
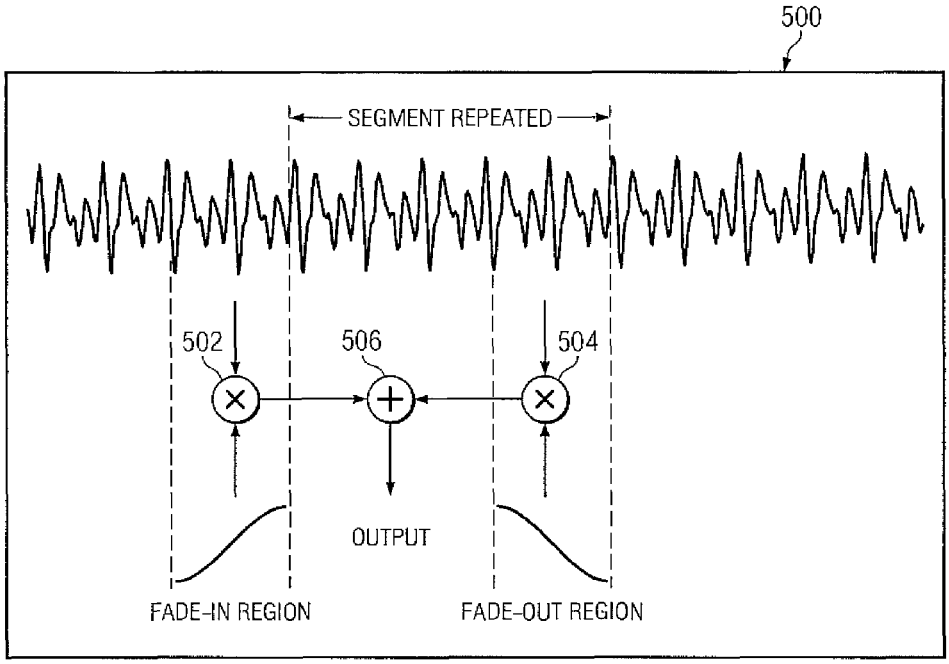
FIG. 5 illustrates an example of stretching a time scale according to embodiments of the present disclosure.

Temporal features, especially transients, are characteristic of the original signal and hence should be preserved whenever possible. Dropping and/or repeating samples will not introduce artifacts only if the signal has a regular periodic waveform. When such a regular periodic waveform exists, such as is illustrated in FIG. 3, the method employs a searching mechanism to determine the optimal splicing points based on some similarity measure. The optimal splicing points are those that give the maximum similarity measure, and the displacement between them is related to the principal frequency of the local waveform. The found splicing points are then joined by cross-fading such that the fade-out region is multiplied with a decaying window and the fade-in region with an increasing window before summing up, to minimize artifacts. The segment in-between the two splicing points are effectively dropped in case of compressing the time scale, as illustrated in FIG. 4, and repeated in case of stretching the time scale, such as, for example, as illustrated in FIG. 5. FIG. 4 illustrates a fade-out region 402 that fade-in region 404 that are combined into an output 406. FIG. 5 illustrates a fade-in region 502 that fade-out region 504 that are combined into an output 506.

Figure 6:
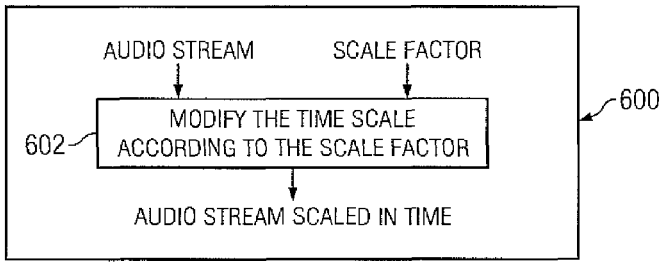
FIG. 6 illustrates a diagram of an interface according to embodiments of the present disclosure.

FIG. 6 illustrates a diagram of an interface according to embodiments of the present disclosure. The embodiment of the interface shown in FIG. 6 is for illustration only. Other embodiments could be used without departing from the scope of this disclosure.

The high-level functional block 600 diagram of the proposed interface is shown in FIG. 6. FIG. 6 illustrates a modify the time scale according to the scale factor 602. The interface can accept a scale factor according to which the time scale of the input signal will be changed. The output is the time-scaled signal. In one embodiment of the present disclosure, the input signal is buffered in a memory that can be accessed through one or more reading pointers. The locations in the buffer relate to the actual time.

Figure 7:
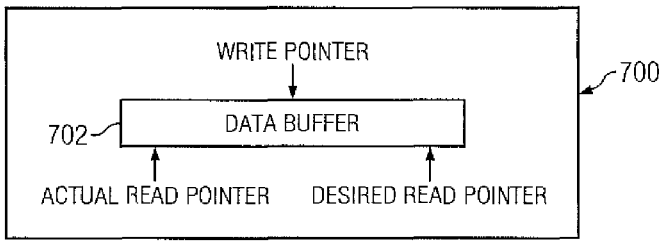
FIG. 7 illustrates a diagram of a data buffer according to embodiments of the present disclosure.

FIG. 7 illustrates a diagram 700 of a data buffer 702 according to embodiments of the present disclosure. In FIG. 7, the 'write pointer' is the location of the next input sample, 'actual read pointer' is the location of the next output sample, and 'desired read pointer' the ideal location (time) of the next output sample. Hence, the displacement between the 'actual read pointer' and the 'desired read pointer' is the drift from ideally scaled time.

Figure 8:
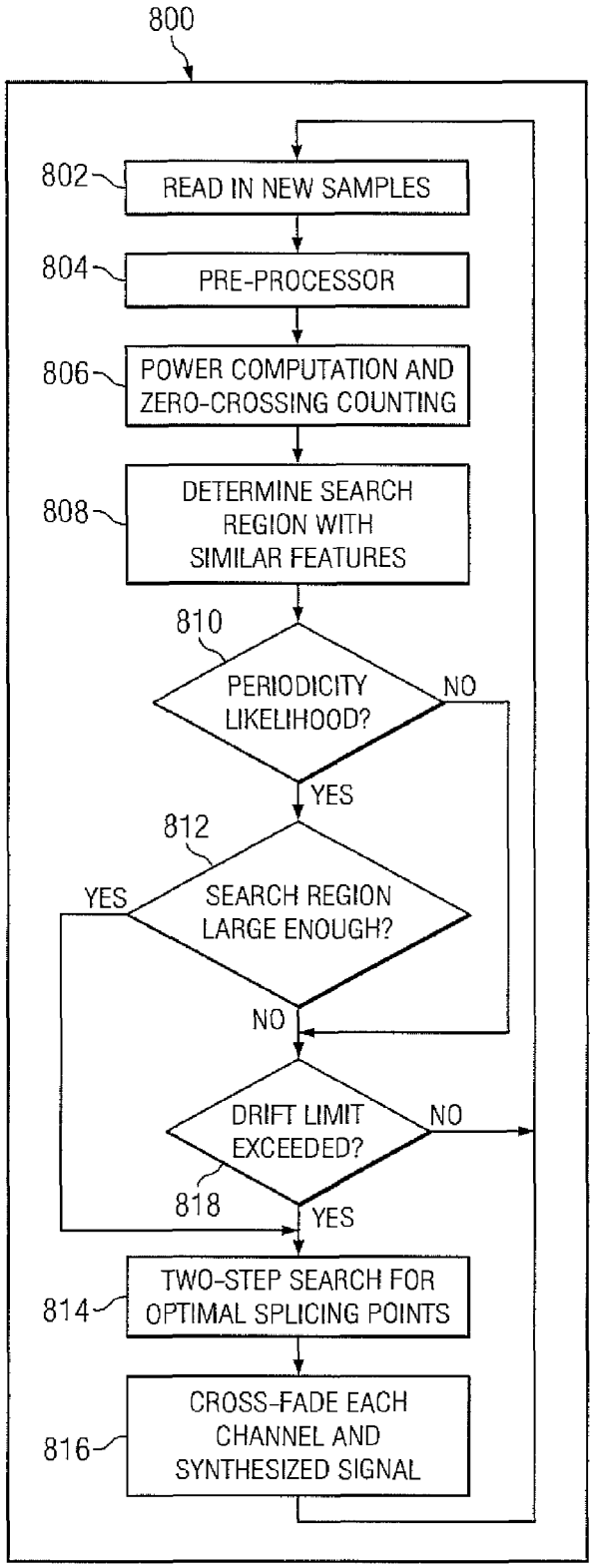
FIG. 8 illustrates a flowchart for a process of modifying a time scale according to embodiments of the present disclosure.

FIG. 8 illustrates a flowchart 800 for a process of modifying a time scale according to embodiments of the present disclosure. The embodiment of the process shown in FIG. 8 is for illustration only. Other embodiments could be used without departing from the scope of this disclosure.

In FIG. 8, new samples are read into in block 802. The pre-processor can synthesize the input single-channel or multiple-channel audio signal for processing with optional features that can be tailored to give preferences to particular audio channels and/or frequency bands in block 804. The present disclosure analyzes the temporal features of the synthesized signal and identifies a region to search for the optimal splicing points. In one embodiment, the temporal features are characterized by power (envelope) variation and zero-crossing count in block 806. In block 808, there is a determination of a search region with similar characteristics. In block 810, there is a determination of a periodic likelihood. If there is no periodic likelihood determined in block 810, there is a determination if a drift region limit has been exceed in block 818. If there is periodic likelihood determined in block 810, there is a determination if a search region is large enough in block 812. If the search region is not large enough, there is a determination if a drift region limit has been exceed in block 818. If the search region is large enough, there is a two-step search for optimal splicing points in block 814 and then cross fading of each channel and synthesized signal in block 816. If the drift limit is exceeded in block 181 then there is a two-step search for optimal splicing points in block 814 and then cross fading of each channel and synthesized signal in block 816. If the drift limit is not exceeded, new samples are read in block 802.

The likelihood of existence of regular periodic waveform is estimated by combining the local power variation in the buffered signal and the zero-crossing count, and if it is high, a search region is identified and search for two splicing points is carried out by a two-step search method; otherwise, new samples are read into the buffer and the processing resumes with the pre-processor.

For reduced computational cost, the two displaced segments, whose similarity measure is to be computed when searching for the optimal splicing points, should be downsampled. Furthermore, the accuracy of similarity measure can be improved by using two downsampled signals for each segment with different downsampling factors, instead of one downsampled signal for each segment. The computational complexity can be controlled by the two downsampling factors. Additionally, the said two-step search method reduces the two-dimensional search problem into a linear search problem, and achieves excellent trade-off between quality and complexity.

In one embodiment of the present disclosure, the time scale modification method can handle up to C channels. Each channel may be processed independently or jointly, where in the former case the processing decisions are made based on each channel, and in the latter case the processing decisions are made on a synthesized signal. Processing each channel independently can ensure the best quality for each channel, but with the disadvantages of (1) higher computational cost and (2) channels being out of synchronization slightly when the channel-based decisions are not identical.

Alternatively, using one synthesized signal to make decisions and then splicing each channel signal at the same sample locations results in perfect synchronization between channels at a reduced computation cost. In the following examples, it is assumed that one synthesized signal is formed from the input channel(s) by the pre-processor and stored in a buffer, and analysis is done on this synthesized signal to make decisions. Note that in this case, the read pointers and write pointers of the data buffers for all channels including that for the synthesized signal are corresponding to the same time instance.

Figure 9:
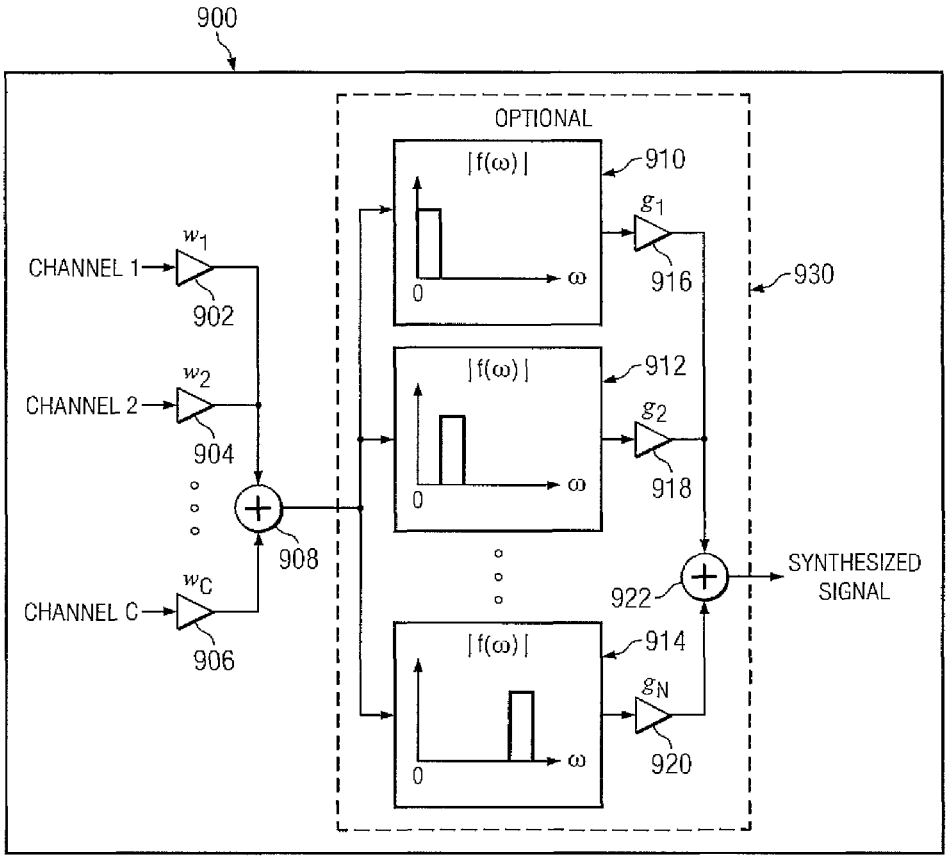
FIG. 9 illustrates a pre-processor forming the correlation signal according to embodiments of the present disclosure.

FIG. 9 illustrates a pre-processor 900 forming the correlation signal according to embodiments of the present disclosure. The embodiment of the pre-processor shown in FIGURE is for illustration only. Other embodiments could be used without departing from the scope of this disclosure. The pre-processor 900 comprises three channels each of with an amplifier 902, 904, and 906 which are combined in combining module 908. Combining module 908 feeds a signal into an optional processing module 930. For multiple input channels, a synthesized signal S(n) is obtained by down-mixing, with weights distributed according to the importance of each channel $S_i(n)$, as shown in Equation 1:

$$S(n) = \sum_{i=1}^{C} w_i S_i(n) \quad \text{[Eqn. 1]}$$

In Equation 1, $w_i$ is the weight assigned to channel i, and their sum typically gives unity as shown in Equation 2 below.

$$\sum_{i=1}^{C} w_i = 1 \quad \text{[Eqn. 2]}$$

The down-mixed signal S(n) may be further filtered into a plurality of frequency bands (subbands) 910, 912, and 914, and then a gain with amplifiers 916, 918, and 920 is applied to each subband signal to emphasize or deemphasize the importance of that frequency band, depending on the relative magnitude of the gains. These weighted subband signals are summed in sum module 922 up to produce the final synthesized signal to be used in the later processing.

Temporal features of the synthesized signal are analyzed to determine the likelihood of existence of regular periodic waveform. This analysis is done segment by segment, where for time compression, the analysis segment is between the current read pointer and the write pointer or an earlier location, and for time stretching it is between some location (before or after the current read pointer) and the write pointer or an earlier location. The duration of the analysis segment is preferably between '37.5' milliseconds and '62.5' milliseconds. The displacement between the current read pointer and the ideal read pointer is tracked so that the drift can be maintained below a limit.

In one embodiment, the analysis segment of the synthesized signal is further divided into B sub-blocks, with $N_B$ samples each corresponding to about '6.5' milliseconds. The average power, denoted $\overline{P}_i$, and peak power denoted $P_i$, of each sub-block is computed, respectively, as shown below in Equations 3 and 4:

$$\overline{P}_i = \frac{\sum_{n \in B_i} |S(n)|^2}{N_B} \quad \text{[Eqn. 3]}$$

$$P_i = \arg\max_{n \in B_i} |S(n)|^2 \quad \text{[Eqn. 4]}$$

In Equations 3 and 4, $B_i$ is the sample indices belong to the ith sub-block.

The motivation for dividing the analysis segment into smaller sub-blocks is to localize local peaks in the signal envelope that often represent significant information and should be preserved whenever possible. Unfortunately, there may be no easy way of having the 'right' sub-block size to capture these local peaks, in addition to the fact that one peak may be spreading across two consecutive sub-blocks. Considering these drawbacks of fixed sub-block size and arbitrary partitioning boundaries, it is preferable to derive a composite power for each sub-block as shown in Equation 5:

$$P_i^c = \alpha \overline{P}_i + (1-\alpha) P_i \quad \text{[Eqn. 5]}$$

In Equation 5, $\alpha$ controls the contribution of average power to the final power measure. A higher $\alpha$ value favours relatively slow-changing sub-blocks, while a lower $\alpha$ value favours sub-blocks with large peak magnitude. On one example, $\alpha$=0.5 has been found adequate for many signals.

The maximum sub-block peak power in the said analysis segment, denoted $P_s$, is found as $$P_s = \arg\max_i P_i.$$

Similarly, the maximum sub-block composite power in the analysis segment, denoted $P_s^c$, is found as $$P_s^c = \arg\max_i P_i^c.$$

The overall maximum peak power, denoted $P_{max}$, and overall maximum composite power, denoted $P_{max}^c$, are updated, for use in other modules to be described later, according to the following pseudo code:

```
If ( Ps > Pmax )
    Pmax = Ps
Else
    Pmax = β1Pmax + (1 − β1)Ps
If ( Ps^c > Pmax^c )
    Pmax^c = Ps^c
Else
    Pmax^c = β2Pmax^c + (1 − β2)Ps^c
```

$P_{max}$ and $P_{max}^c$ can be initialized to any positive values corresponding to typical sound loudness when the processing is first invoked, e.g., −10 dB or −20 dB. Further, $\beta_1$ controls the decay rate, or forgetting factor, of the previous maximum peak power, and $\beta_2$ controls that of the previous maximum composite power. These two parameters both relate to the quickness of adaptation of the processing to the local characteristics. Since $P_{max}$ and $P_{max}^c$ are updated once for each temporal analysis, $\beta_1$ and $\beta_2$ should be made proportional to the average interval between two updates. Specifically, if the forgetting factor is chosen to be '0.5' after $T_1$ seconds for $P_{max}$ and after $T_2$ seconds for $P_{max}^c$, respectively, and the average interval between two updates is $\lambda$, then Equations 6 and 7 below result:

$$(\beta_1)^{\frac{T_1}{\lambda}} = 0.5 \quad \text{[Eqn. 6]}$$

$$(\beta_2)^{\frac{T_2}{\lambda}} = 0.5 \quad \text{[Eqn. 7]}$$

Equations 6 and 7 can be used to solve for $\beta_1$ and $\beta_2$.

The number of zero-crossings in the analysis segment is also counted, with thresholding to eliminate insignificant crossings. An insignificant crossing occurs when the waveform crosses the horizontal axis with very 'small' power (in the relative sense). Since the input could be pre-scaled up or down, it is not possible to recognize insignificant using an absolute threshold for all cases. Instead of using an absolute threshold, in one preferred embodiment, a relative threshold with respect to the previously found maximum peak power is used. The relative threshold $TH_{zc}$ is chosen to be the relationship shown in Equation 8:

$$TH_{zc} = \gamma\sqrt{P_{\max}} \quad \text{[Eqn. 8]}$$

In Equation 8, $\gamma$ is a real number between 0 and 1. Using the relative threshold have the advantage of adapting the analysis to local characteristics of the signal, because it is the relative power (magnitude) that matters to human perception due to the temporal masking property of psychoacoustics. The pseudo code for counting the zero-crossings of each sub-block is as follows, with the result stored in an array named ZC:

```
for i = 1, 2,...B
    ZC(i) = 0;
    prev = the sample immediately preceding sub-block i
    For each sample s(n)
        mag = magnitude of s(n)
        If (mag > THzc AND s(n)*prev < 0)
            ZC(i) = ZC(i) + 1;
            prev = temp;
```

Note that each sample in the analysis segment only needs to be accessed once for computing the maximum peak power, average sub-block power and zero-crossing counting, as the analysis segment is made up of consecutive sub-blocks.

With the array of found average sub-block power $[P_1^c\ P_2^c \ldots P_B^c]$, the longest region of consecutive sub-blocks with similar envelope (characterized by composite power) is found by the following steps. In one embodiment, the array $[P_0^c\ P_1^c\ P_2^c \ldots P_B^c]$, where $P_0^c$ is the composite power of the sub-block substantially immediately preceding the current analysis segment, is first low-pass filtered to smooth the signal envelope, where the low-pass filter can be a simple low-order finite impulse response (FIR) filter. The elements in the low-pass filtered, or smoothed, power array, denoted $[E_0^c\ E_1^c\ E_2^c \ldots E_B^c]$, can be initially assigned with the same marker and then processed to locate local peaks. Except the first element, each element will receive the same marker as the preceding one if the ratio between the current element and the preceding one is within a range. Taking into account the temporal masking property, the actual upper bound and lower bound of the range should depend on the normalized power with respect to the found maximum composite power $P_{max}^c$.

```
PowerThresh = μ* P_max^c
marker[1] = 0;
for i = 2, 3,...B
    npow = MAX( E_{i-1}^c, E_i^c )/ P_max^c
    if (npow < PowerThresh)
        marker[i] = marker[i-1]
    else
        upLimit = find_upper_threshold(npow)
        lowLimit = find_lower_threshold(npow)
        If ( E_i^c > E_{i-1}^c *lowLimit AND E_i^c < E_{i-1}^c *upLimit)
            marker[i] = marker[i-I]
        else
            marker[i] = 1 - marker[i-1]
```

It is noted that μ is a pre-defined constant, and $0 \le \mu \le 1$. MAX(•) returns the larger value of the two arguments. The two functions find_upper_threshold(•) and find_lower_threshold(•) return the upper bound and lower bound of the range within which the signal envelope is considered smooth. The thresholds can be designed to tolerate more variation when the (normalized) signal power is low, and tolerate less variation when the (normalized) signal power is high, because the perceptual importance is low in the former case and high in the latter case.

Figure 10:
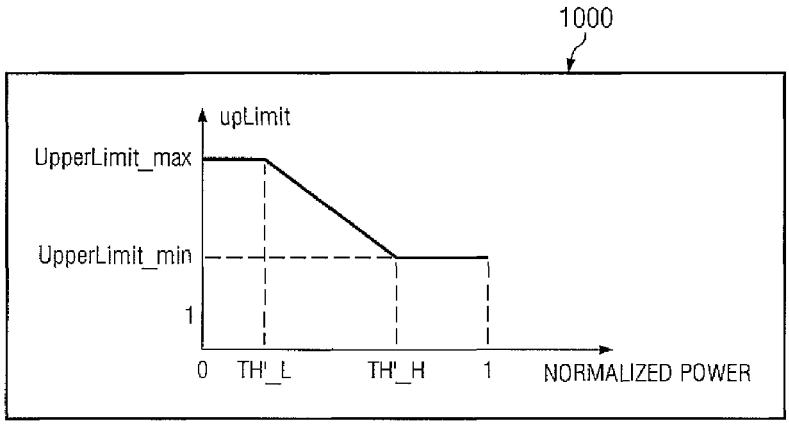
FIG. 10 illustrates an example of a function curve used for the calculation of the upper bound of the tolerated power variation according to embodiments of the present disclosure.
Figure 11:
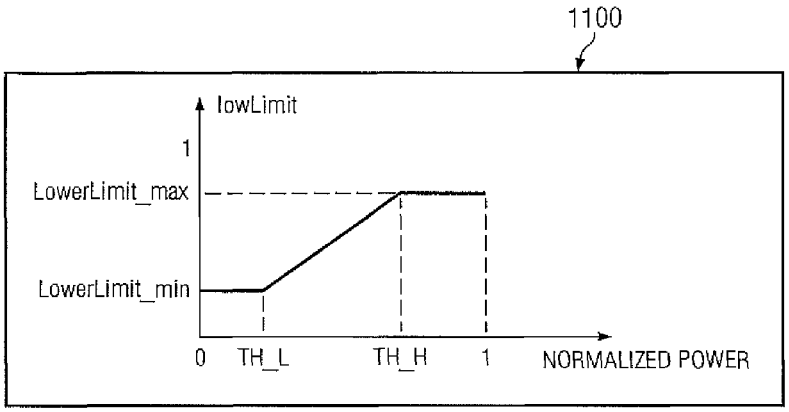
FIG. 11 illustrates an example of a function curve used for calculation of the lower bound of the tolerated power variation according to embodiments of the present disclosure.

The thresholds are better determined with normalization with respect to the found maximum composite power $P_{max}^c$, so as to eliminate dependency on the absolute power which could vary widely from signal to signal. Exemplary curves used to calculate the upper and lower thresholds are shown in FIG. 10 chart 1000 and FIG. 11 chart 1100, respectively. Note that the maximum of the current element and the previous element is used for computing these thresholds. To improve robustness of embodiments of the present disclosure, the sub-blocks with power below a threshold (PowerThresh) is treated as 'don't care', and they assume the same marker.

Figure 12:
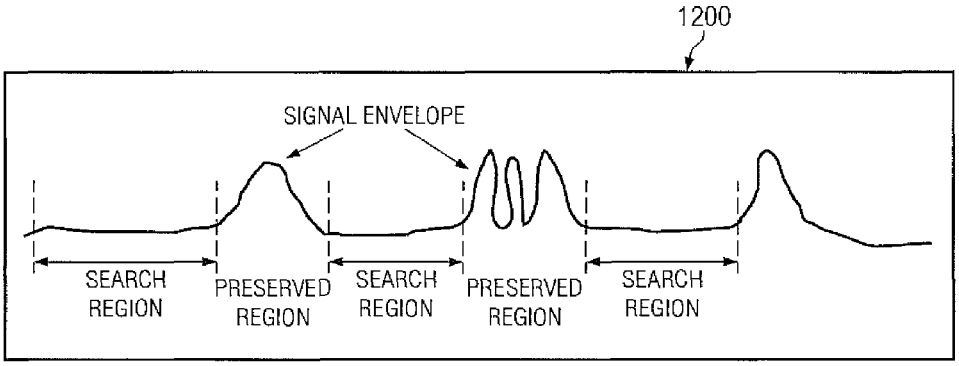
FIG. 12 illustrates an example of a signal envelope and the desired classification of regions to be processed and preserved according to embodiments of the present disclosure.

Once the sub-blocks are all marked with markers of '0' or '1', it can be easy to find out the longest consecutive region with the same marker, hence similar envelope. For example, if the markers are [0 1 1 0 0 0 0 1], from the 4th sub-block to the 7th sub-block, inclusive, is the longest region having similar envelope, and the $2^{nd}$ and $3^{rd}$ sub-blocks correspond to a transient change in envelope. The found longest consecutive region with the same marker is called the 'search region' in the following description. Some examples of search regions are shown in FIG. 12 illustration 1200.

In one embodiment, the likelihood of existence of regular periodic waveform in the identified search region is determined by the total number of zero-crossings in the found search region, as follows:

```
j = the first sub-block of the search region
k = the last sub-block of the search region
totalZC = ZC(j) + ZC(j+1) + ... + ZC(k)
avgPow = ( P_j^c + P_{j+1}^c +...+ P_k^c)/(k-j+ 1)
avgPowN = avgPow/ P_max^c
if (totalZC < ZC_LOW_TH)
    ρ = 1
else
    ρ = totalZC / MAX(ZC_LOW_TH , (k-j+1)*
    ZC_PER_BLOCK*avgPowN)
```

ZC_LOW_TH and ZC_PER_BLOCK are predefined constants. ZC_LOW_TH is a threshold, which states that if the total zero-crossings are below this value, the signal is considered as changing very slowly, almost like a DC signal. ZC_PER_BLOCK relates to an expected number of zero-crossings in one sub-block that is highly periodic. The likelihood of existence of regular periodic waveform in the current analysis segment is considered high if $\rho > \rho_{TH}$ low otherwise, where $\rho_{TH}$ is a pre-defined threshold and $0 \le \rho_{TH} \le 1$.

The search region needs to be at least some size for searching the splicing points. If the size is small, chance for obtaining good splicing points is low. This size limit on the search region can be determined by training the process with sample signals, or by assumptions such as the minimum fundamental frequency to be supported. No search will be carried out if either the likelihood ρ is below threshold or search region is below threshold, and processing proceeds to the new input samples. However, this decision may be overridden if the drift from the ideal read pointer has been too large (typically around 20 milliseconds), in which case the search region is reset to the whole analysis segment (refer to the three diamond-shaped decision boxes in FIG. 8).

The optimal splicing points in the identified search region can be found based on some similarity measure such as maximum normalized cross-correlation, minimum sum of differences, etc. In one embodiment, a similarity measure similar to normalized cross-correlation is used, but without square operations to save computation, is computed as shown in Equation 9:

$$COR(j,k) = \frac{\sum_{i=0}^{M-1} S(j+i)*S(j+k+i)}{\sum_{i=0}^{M-1} |S(j+i)| * \sum_{i=0}^{M-1} |S(j+k+i)|} \quad \text{[Eqn. 9]}$$

In Equation 9, the first index j is the starting location for the first segment with reference to the starting of the search region, the second index k is the offset between the two segments, and M is the size of the segments to be cross-correlated.

In order to reduce computation, in one embodiment, the two segments can be downsampled by a factor of D and Equation 10 below results:

$$COR(j,k) = \frac{\sum_{i=0}^{M/D-1} S(j+i*D)*S(j+k+i*D)}{\sum_{i=0}^{M/D-1} |S(j+i*D)| * \sum_{i=0}^{M/D-1} |S(j+k+i*D)|} \quad \text{[Eqn. 10]}$$

However, downsampling by D can lead to the spectral aliasing and the similarity measure may consequently fail for frequencies at 1/(2*D), 2/(2*D), 3/(2*D), . . . , D/(2*D) of the sampling frequency. To overcome this difficulty, in one embodiment, two downsampled signals, by factors of $D_1$ and $D_2$, respectively, are used for computing the similarity measure, as shown in Equation 11:

$$COR(j,k) = \frac{\left(\sum_{i=0}^{M/D_1-1} S(j+i*D_1)*S(j+k+i*D_1)\right) + \left(\sum_{i=0}^{M/D_2-1} S(j+i*D_2)*S(j+k+i*D_2)\right)}{\left(\sum_{i=0}^{M/D_1-1} |S(j+i*D_1)| + \sum_{i=0}^{M/D_2-1} |S(j+i*D_2)|\right) * \left(\sum_{i=0}^{M/D_1-1} |S(j+k+i*D_1)| + \sum_{i=0}^{M/D_2-1} |S(j+k+i*D_2)|\right)} \quad \text{[Eqn. 11]}$$

When $D_1$ and $D_2$ are chosen to be relative prime, all frequencies can be handled. Furthermore, both $D_1$ and $D_2$ are related to the computational complexity.

The above similarity measure involves a division operation, which is often costly in today's hardware. However, note that for the search of the maximum similarity, the actual similarity values do not matter; we only need to compare them. Thus, for two similarity values, COR(j, k) and COR(m, n), their relationship can be determined without any division such that COR(j, k)>COR(m, n) if and only if the relationship shown by Equation 12 exists:

$$\text{numerator}(COR(j,k))*\text{denominator}(COR(m,n))>\text{numerator}(COR(m,n))*\text{denominator}(COR(j,k)) \quad \text{[Eqn. 12]}$$

In Equation 12, the numerator(•) returns the numerator of its argument, and denominator(•) returns the denominator of its argument.

The displacement between the two splicing points relates to the fundamental period of the signal, and hence should be allowed to vary within a range. Thus, by linearly moving the first candidate splicing point through $M_1$ locations and linearly moving the second candidate splicing point through $M_2$ locations with the first candidate splicing point fixed, all the possible combinations, $M_1*M_2$ in total, can be checked. This may be, however, too computationally demanding in practice, especially for real-time processing applications.

In one preferred embodiment of the present disclosure, a two-step search approach is employed to reduce the two-dimensional search problem into a linear search problem. In the first step, the first candidate splicing point is moving at fine steps, denoted Hop1, and the second candidate splicing point is moving at large steps, denoted Hop2. Let $(j, k_j)$ denote a combination of the candidate splicing points with the first candidate splicing point at j*Hop1 and the second candidate splicing point at j*Hop1+MinShift+$k_j$*Hop2, where $0 \le j \le J$, $1 \le k_j \le K_j - 1$, and MinShift is the allowed smallest displacement between the splicing points.

To avoid dropping or repeating too many samples at a time, it is also advantageous to limit the maximum displacement between the splicing points, denoted as MaxShift. It is then clear that $K_j$*Hop2≤MaxShift−MinShift, and, in addition, j*Hop1+MinShift+$K_j$*Hop2 should still within the search region (see FIG. 13, diagram 1300). At the end of the first step, the pair $(j_{max}, k_{max})$ is identified as the combination of candidate splicing points that gives the maximum similarity as shown in Equation 13:

$$(j_{max}, k_{max}) = \underset{j,k_j}{\operatorname{argmax}} COR(j*Hop1,\ j*Hop1 + MinShift + k_j*Hop2) \quad \text{[Eqn. 13]}$$

Figure 13:
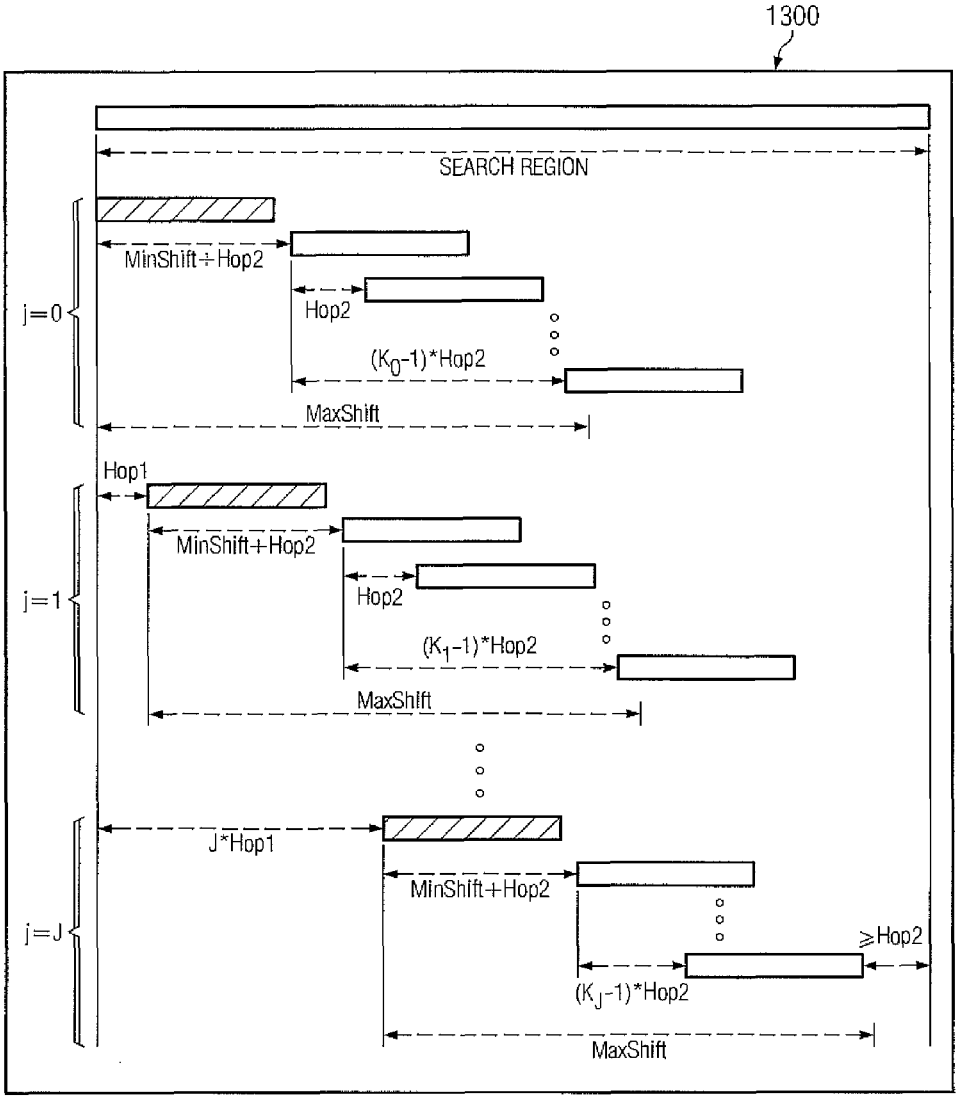
FIG. 13 illustrates a first search step in a two-step search carried out within the identified search region according to embodiments of the present disclosure.

The second search step is to continue from the identified pair $(j_{max}, k_{max})$, and linearly move the second candidate splicing point at very fine steps within a window centred at $j_{max}$*Hop1 MinShift+$k_{max}$*Hop2, with the first splicing point is fixed at $j_{max}$*Hop1. The search window size for the second splicing point can be limited to 2*Hop2, under the assumption that the similarity measure exhibits slow cycles with linear displacement, such as, for example, as illustrated in FIG. 13. At the end of the second step, the location for the second candidate splicing point is identified as shown in Equation 14:

$$(j_{max}, k_{max}, l) = \underset{l}{\operatorname{argmax}} COR(j_{max}Hop1,\ j_{max}*Hop1 + MinShift + k_{max}*Hop2 + l) \quad \text{[Eqn. 14]}$$

In Equation 14, −Hop2≤l≤Hop2.

With optimal splicing points identified, cross-fading is carried out, where samples are dropped to compress the time scale as shown in FIG. 4, or are repeated to stretch the time scale as shown in FIG. 4.

Figure 14:
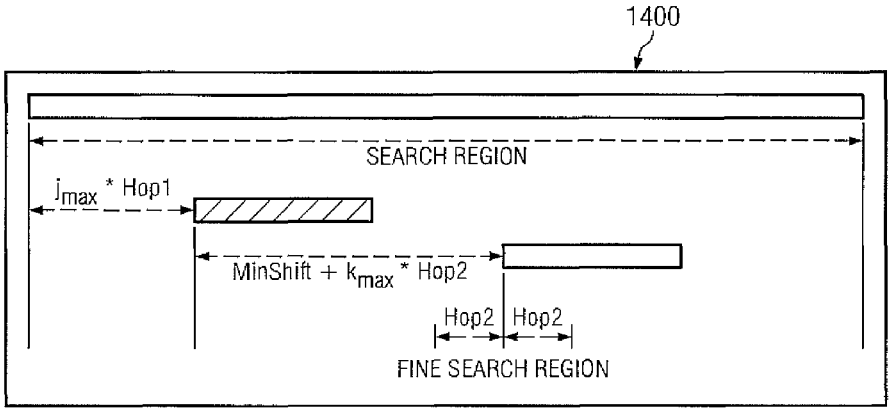
FIG. 14 illustrates a second search step in the two-step search carried out following the first search step according to embodiments of the present disclosure.

FIG. 14 illustrates diagram 1400 showing a second search step in the two-step search carried out following the first search step according to embodiments of the present disclosure.

Accordingly, the present disclosure provides a method to modify the time scale of digital audio signals with well-controlled computational complexity. In one embodiment, the present disclosure forms one synthesized signal for multiple input channels so that computation is minimized. Important temporal features such as transients are well-preserved, and samples are dropped/repeated mostly in more regular regions so that artifacts are minimized. Drift from the ideal time scale is controlled so that content synchronization can be maintained with other types of contents, e.g., video. The total computational complexity can be controlled by setting the relevant parameters.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A method, comprising:

reading in at least one sample using at least one processor;

determining power variation for each of a plurality of sub-blocks within the at least one sample and performing zero-cross counting on the at least one sample to determine a likelihood of existence of a regular periodic waveform within the at least one sample;

based on the determined likelihood of existence of a regular periodic waveform within the at least one sample, determining search regions of the at least one sample with similar features;

determining at least two splice points within the at least one sample using a two-step search, the at least two splice points each marking where a time scale can be modified without introducing artifacts or losing content;

cross fading each channel of the at least one sample when dropping or repeating sub-blocks at the at least two splice points; and synthesizing an output based upon the at least one sample.

2. The method of claim 1, further comprising:

pre-processing the at least one sample.

3. The method of claim 2, further comprising:

determining the likelihood of existence of a regular periodic waveform within the at least one sample based on maximum peak power and average sub-block power.

4. The method of claim 3, further comprising:

determining if a search area is large enough.

5. The method of claim 4, further comprising:

upon determining that one of the search regions is not large enough, determining if a drift limit has been exceeded.

6. The method of claim 5, wherein each of the at least two splice points is determined upon determining that the drift limit has been exceeded.

7. The method of claim 5, further comprising:

upon determining that the drift limit has not been exceeded, reading in at least a second sample.

8. The method of claim 3, further comprising:

upon determining that there is no periodic likelihood in the at least one sample, determining if a drift limit has been exceeded.

9. The method of claim 1, wherein the synthesized output is sent to at least one speaker.

10. The method of claim 1, wherein the synthesized output is digital-to-analog converted.

11. The method of claim 1, wherein the drift limit corresponds to a drift from an ideally scaled time and is controlled below a pre-defined threshold.

12. The method of claim 1, wherein the at least one sample is received, decoded, and pulse code modulation (PCM)-processed.

13. A time-domain system, comprising:

a pre-processor configured to:

form a synthesized signal for processing, wherein the synthesized signal gives preference to at least one of: certain audio channels and certain frequency bands, adaptively determine a likelihood of existence of a regular periodic waveform within the synthesized signal by determining a normalized power for each of a plurality of sub-blocks within the synthesized signal and a zero-crossing count for the synthesized signal, based on the determined likelihood of existence of a regular periodic waveform within the synthesized signal, determine search regions with similar features within the synthesized signal, and identify a segment of the synthesized signal marked by two splicing points where a time scale can be modified without introducing artifacts or losing content; and an output for the segment of the synthesized system.

14. The system of claim 13, wherein the identification of the two splicing points is preformed within a previously identified segment of the signal.

15. The system of claim 14, wherein a drift from an ideally scaled time is controlled below a pre-defined threshold.

16. The system of claim 14, wherein the pre-processor comprises:

an input configured to receive a signal, a decoder configured to decode the received signal, and a pulse code modulation (PCM)-processing module configured to process the received signal, wherein the pre-processor accepts the signal, decodes the signal, and transmits the decoded signal into the PCM-processing module.

17. The system of claim 16, wherein the pre-processor further comprises:

a time and scale modification module configured to modify the processed signal, wherein modifying the processing signal comprises one of: dropping a segment of the processed signal and repeating a segment of the processed signal; and an output for the modified signal.

18. The system of claim 17, wherein the output for the modified signal is configured to send the modified signal to at least one speaker.

19. The system of claim 14, wherein the pre-processor further comprises a modulated signal into time and scale modification module configured to receive a signal from the PCM-processing module.

20. The system of claim 14, wherein the pre-processor further comprises a digital to analog converter configured to feed at least one signal into the output.

21. The system of claim 13, wherein the system is configured to cross fade each channel of the synthesized signal when dropping or repeating sub-blocks at the at least two splicing points.

22. The system of claim 13, wherein the pre-processor is configured to determine the likelihood of existence of a regular periodic waveform within the at least one sample based on maximum peak power and average sub-block power.

* * * * *